United States Patent [19]

Dengel

[11] Patent Number: 4,901,549

[45] Date of Patent: Feb. 20, 1990

[54] KEY RETAINER

[76] Inventor: Donald F. Dengel, 190 E. Division St., Fond du Lac, Wis. 54935

[21] Appl. No.: 240,010

[22] Filed: Sep. 2, 1988

[51] Int. Cl.[4] ..... A47G 29/10

[52] U.S. Cl. ..... 70/456 R; 70/457; 70/458

[58] Field of Search ..... 70/456 R, 456 B, 457, 70/458, 459; 206/37.1, 37.2, 37.3, 37.4, 37.5, 37.6, 37.8; 150/40, 130; 24/3 K; D3/61

[56] References Cited

U.S. PATENT DOCUMENTS

| | | | |
|---|---|---|---|
| 2,546,413 | 3/1951 | Williams | 206/37.2 |
| 2,789,613 | 4/1957 | Corsaw | 70/456 R |
| 2,931,210 | 4/1960 | Agee, Jr. | 70/456 R |
| 3,680,338 | 8/1972 | Lee | 70/456 R |
| 4,417,612 | 11/1983 | Couture et al. | 206/37.4 |
| 4,785,645 | 11/1988 | Dengel | 70/456 R |

*Primary Examiner*—Robert L. Wolfe
*Attorney, Agent, or Firm*—William D. Stokes

[57] ABSTRACT

A key retainer, primarily having the facility for manually manipulating a key from a stored, inoperative position to a partially stored operation position, is disclosed. The key retainer includes a top planar semi-flexible member and bottom planar semi-flexible member, both of which are joined to one another generally, along their perimeters and vertical center lines, to form two adjacent key storing facilities. Each key storing facility is provided with a key receiving-finger manipulating slot for inserting a key within the key storing facility and manual manipulation of the key to move the key from a stored position to a partially stored operative position through an opening provided in the joining means. A major advantage of the key retaining arrangement is the absence of key connecting devices usually associated with key retainers.

8 Claims, 2 Drawing Sheets

FIG. 1
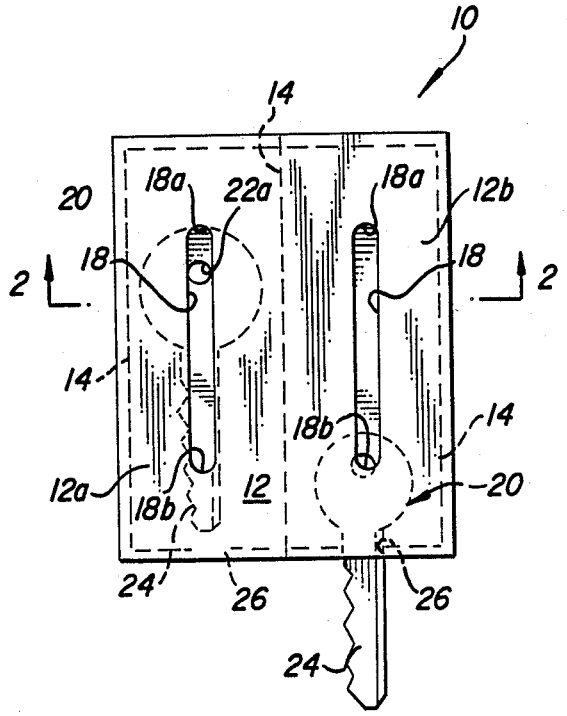
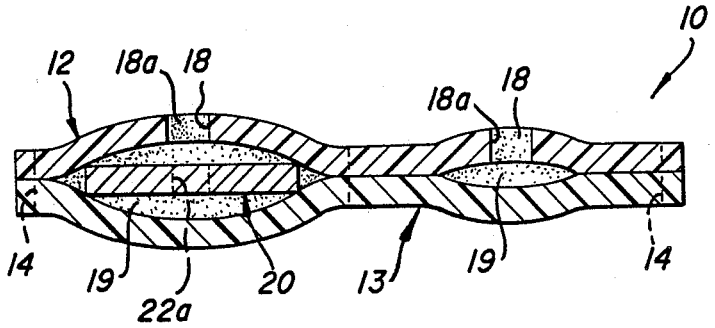
FIG. 2

KEY RETAINER

FIELD OF THE INVENTION

The present invention relates to pocket- or wallet-insertable key holders, retainers and the like, more particularly key retainers of the "ringless" type which include facility for manually manipulating the keys (or key) from stored inoperative positions to partially stored (or attached) locking/unlocking positions.

BACKGROUND OF THE INVENTION

This application is copending with application Ser. No. 07/061,532 filed June 15, 1987 and now U.S. Pat. No. 4,785,645. Key retainers, especially those having the capability of being carried within a user's pocket or wallet, have been well known for many years. Other than a conventional key ring, most key retainers are provided with securing means for holding the key(s) in a stored position within a housing or encasement, primarily to prevent the key(s), when placed in a user's pocket, from ripping and puncturing the fabric of the pocket. The securing means for holding the key in a stored position may also include a construction enabling one to manually manipulate or extend the key to a working locking/unlocking position, in other words, the key may be partially withdrawn from the retainer to expose the working end of the key.

There is known in the art key retainers equipped with slidable key securing means permitting a user to slide a key from a stored inoperative position to a partially stored (or attached) operative position. In such devices, the key is usually secured to a recess or channel provided in the retainer's housing via a pin or other securing means, in such manner as to allow the key to be partially withdrawn from the retainer. Segal U.S. Pat. No. 1,924,134; Williams No. 2,546,413; Leff No. 2,608,851; Abraham No. 3,224,052; and Shelton No. 3,315,505, all disclose key retainers including channels, guides or recesses for allowing a key(s) to be transferred from a stored position to a working position. However, while these above-discussed patents show key retainers which operate effectively and without much effort, the keys must be connected to the retainer's channel or guide via some type of connecting means, such as a pin or fastener positioned through the key's typical aperture, for allowing the keys to be manually manipulated or extended to working positions. Due to the construction of this type of key retainer, often times the pins or fasteners become dislodged from the keys (and recesses) especially after long periods of use, causing the keys to be either lost or misplaced from their retainers. In addition, key retainers having slidable key connecting means may be adapted to be carried within pockets, but due to the thickness of the retainer's structure, are not readily insertable within wallets and the like, and if inserted cause unwanted bulges.

Cheney U.S. Pat. No. 2,173,008, shows a key holder having a construction similar to those discussed above which incorporates a spring biased device to hold and secure the key within the retainer's channel. Spring-biased key retainers have the disadvantage of being difficult to manufacture and require the use of pins or screws to mount the springs to the retainer, the pins or screws frequently being dislodged after extended use of the retainer.

Starett U.S. Pat. Nos. 2,836,053 and 3,004,422, and Taylor U.S. Pat. No. 2,897,667, all disclose key holders which utilize pivotal key connecting means for pivotally swinging a key from within its holder to a position of operation. Again, while these patents show key retainers which operate without much effort, the keys must still be secured to the key connecting means via pins, rings or screws, which may have the tendency to be dislodged from the keys after the key holder has been used several times.

Magnetic type key holders have recently been available on the market which magnetically secure a key to the holder. For example, the Lee U.S. Pat. No. 3,680,338, discloses a magnetic receptacle for keys, but still requires the utilization of key rings to secure a key within a magnetic channel or recess.

Attempts have been made to provide a key retainer which may be inserted within the pockets or folds of wallets. For the most part, these retainers are formed of semi flexible or rigid stiff like materials for structuring and configuring the retainer to somewhat of a credit card like appearance, permitting the key retainer to be inserted and carried within the credit card pockets and folds of wallets. Kernicki U.S. Pat. No. 2,734,624, exemplifies a wallet-insertable key holder formed of molded stiff like plastic materials, including spaced-apart horizontally extending slits which define regions or bands for retaining keys therein. Such constructions have the disadvantage of the fact that since the keys are not connected to the bands, that is, the keys are held within the bands only due to the band's tendency to urge the keys against the planar surfaces of the holder, creates problems of the keys separating from the retainer when sliding a particular key from the holder to a position of operation.

Marks U.S. Pat. No. 4,037,716, illustrates a similar key retaining device having a generally card-like structure. The retainer is incorporated with a pressure resealable adhesively-coated lid, which retains keys and the like underneath the lid. A major disadvantage of such construction is that the lid has the tendency to become worn, messy and extremely cumbersome after repeated use. Moreover, the adhesive employed in this type of key retainer eventually comes into contact with the keys being retained, sticking thereto and consequently contacting the hands of the user.

Heretofore, there has been no key retainer or holder in the art having connection free key storing and serving means, and in particular, a key retainer adapted to be carried within a user's pocket or wallet without causing added bulges. The present invention further offers the advantage of providing a simple and practical key(s) retainer which can be easily and quickly assembled, is relatively inexpensive, and possesses the quality for long lasting use.

SUMMARY OF THE INVENTION

Accordingly, it is an object of the present invention to overcome the deficiencies of the prior art, such as those set forth hereinabove.

It is another object of the present invention to provide an improved key carrying retainer.

It is a further object of the present invention to provide a key retainer having connection free key holder for maintaining a key(s) in a stored position while having the facility for partially removing the key to a working position.

It is still another object of the present invention to provide a key retainer having connection free key securing means, which is readily adapted for insertion within a user's wallet or pocket.

It is still another object of the present invention to provide a key retainer having a substantially flexible card-like structure.

Still other objects, features and attendant advantages of the present invention will become apparent from a reading of the following detailed description of embodiments constructed in accordance therewith, taken in conjunction with the accompanying drawings.

BRIEF DESCRIPTION OF THE DRAWINGS

FIG. 1 is a plan view of an embodiment of a key retainer of the present invention, broken lines, extending generally along the retainer's perimeter and center line, simulating stitched seams;

FIG. 2 is a cross-sectional view of the key retainer of FIG. 1 taken along line 2—2, FIG. 1;

DETAILED DESCRIPTION OF PREFERRED EMBODIMENTS

Figure 3:
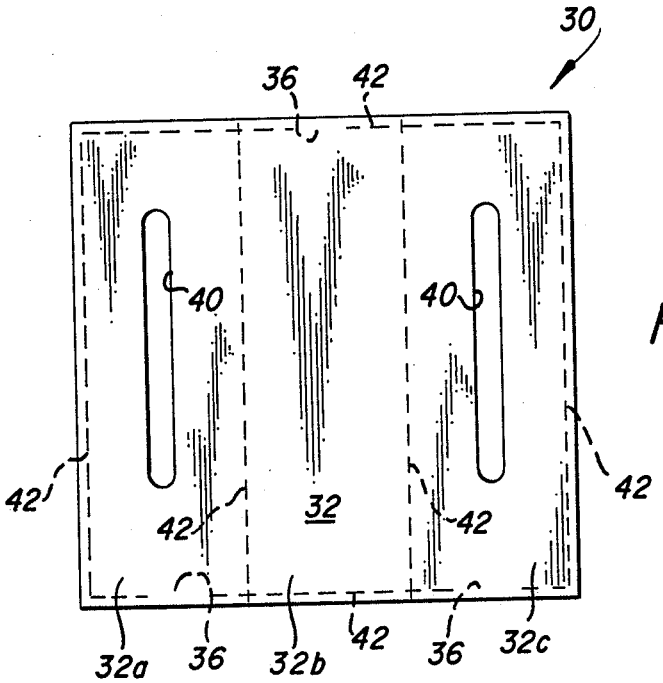
FIG. 3 is a plan view of another embodiment of a key retainer of the present invention, showing one face thereof.

The preferred embodiment of the present invention is illustrated in FIGS. 1 and 2 of the drawings. The key retainer 10 essentially comprises a top, generally planar, flexible member 12 and a bottom, generally planar, flexible member 13, top and bottom members 12, 13 both having preferably rectangular configurations and substantially equivalent dimensions.

Top and bottom members 12, 13 are adapted to oppose one another and are joined to each other generally along their respective perimeter edges (or borders) and along their respective vertical center lines, through the utilization of stitched seams 14, thus forming two adjacent, generally equivalent-sized, regions **12*a*, 12*b*, which form and define, between the top and bottom members, key storing means 19, 19** for holding and retaining keys therein. While it is preferred that the top and bottom members are joined to one another through the use of stitching, it should be understood that various other joining techniques may be employed, for example, adhesives, staples, heat-formed seams or any other suitable fastening means, so long as the fastening means provides a long-lasting bond or connection to securely hold the top and bottom members together, particularly along their respective perimeter borders and vertical center lines. (Details of the joining means are discussed hereinafter).

Top and bottom members 12, 13 are preferably formed of a flexible plastic, leather or leather like material which possesses sturdy yet flexible properties. While the use of leather is preferred, many other materials may be suitably employed, for example, flexible plastic sheet materials, canvas, rubber products, or any other suitable material which offer a resilient and flexible, but semi-rigid characteristics. It is a phenomena of the invention that the semi-resilience or flexibility of the leather or plastic used provides a gripping or holding of the key in the container.

Top member 12 is equipped with generally longitudinally extending key receiving finger manipulating apertures 18, 18 each of which overlies respective key storing means 19, 19. Each slot aperture 18, 18 is in direct communication with each key storing means 19, 19 respectively. Slot apertures 18, 18 are positioned longitudinally with respect to the length of the key holder, and are of a preferably elongated oval configuration, and generally located halfway between the length side and the center line of the retainer 10 on their respective regions **12*a*, 12*b*. Key receiving finger manipulating apertures 18 are positioned so as to expose a portion of the length of a typical key when the key 20 is inserted and held within the key storing means 19, 19. The key receiving finger manipulating apertures 18 should have lengths sufficiently long that a conventional key head, consequently the key, may be readily inserted into the key storing means 19, 19 and widths no wider than that necessary to allow finger manipulation of the key inserted and stored within, thus preventing a key situated within the key storing means from accidentally protruding or falling out of the key storage means through the finger-manipulating apertures. Keys held within the key storing means are removed and inserted through the apertures 18, 18**.

Each key storing means 19, 19 has an opening 26, generally formed between the top and bottom members 12, 13 and a region absent of stitching. The opening 26 defines a space for manipulating a key's working end 24 therethrough to a position for operative use. The key 20 may be moved from a stored inoperative position to a partially stored operative position by simply inserting a thumb or finger within the slot aperture 18 to manually manipulate or push the key to a position of operation, and vice versa. The opening 26 should have a length generally equal to the width of conventional key working ends. The openings 26, provided on each lower end of the key storing means 19, 19 are simply formed by the absence of stitching 14 provided along the edges or sides of the key retainer. The openings are substantially positioned in a longitudinal path with the slot apertures 18, 18 so as to permit easy and direct movement of a key from a position within the key storing means to a partially exposed operative position through the opening 26, the above-mentioned longitudinal path being substantially parallel to the length sides of the retainer. It is to be understood that the openings 26 should not be greater in width than a typical key head, to prevent the key from entirely leaving the key retainer when manipulating the key to an operative position or during use of the key.

In operation, a key to be retained is inserted through the aperture 18 and positioned for storage within the key storing means 19 in a direction that the operative end of the key is directed toward opening 26. When desired, the working end of the key can be manually manipulated or extended, via manual manipulation through aperture 18, to a position of operation as illustrated in the right hand side **12*b* of the key retainer shown in FIG. 1. The key may be readily resituated to a position of storage within the key storing means 19** after the key has been used, by simply pushing the working end of the key in a direction parallel to the retainer's length sides.

Figure 4:
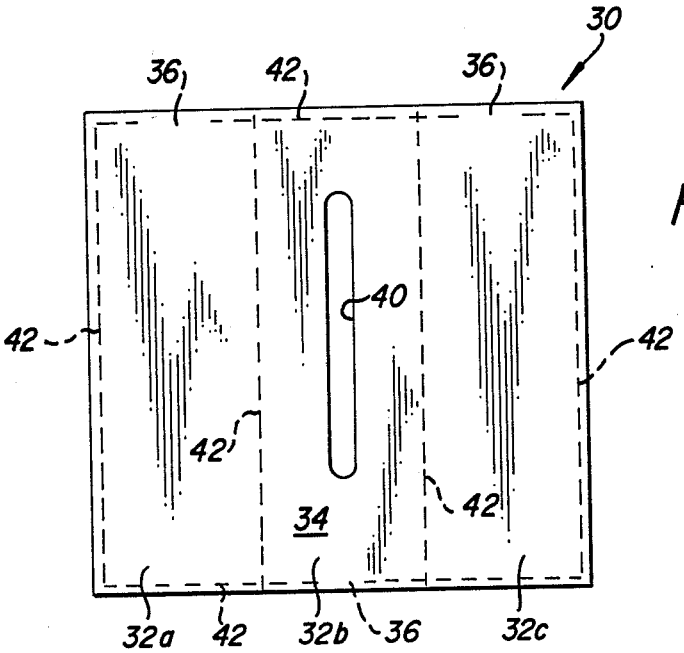
FIG. 4 is a plan view of the embodiment shown in FIG. 3, illustrating the other thereof.

Referring now to FIGS. 3 and 4 of the drawings, an alternate embodiment of the present invention is shown. The key retainer 30, shown as a three fold storage compartment arrangement, includes a top planar, semi flexible member 32 and a bottom planar semi flexible member 34. Both the top and bottom members 32, 34 are of identical rectangular configurations and are adapted to oppose one another. As in the embodiment of FIG. 1, top and bottom members are joined together, via stitching 42, generally along their perimeter edges and along two vertical lines which divide the members 32, 34 into three equally-dimensioned key retainers designated as 32*a*, 32*b* and 32*c*. The two outside key retainers 32*a* and 32*c*, include a top member each having a generally longitudinally extending key insertion-finger manipulating apertures 40. Each aperture 40 being generally positioned in the vertical center of the respective top areas 32*a*, 32*c*. The bottom planar member 34 includes, in its key storing facility 32*b*, a key insertion-finger manipulating aperture 40 (see FIG. 4). Openings 36 are provided between bottom member 34 and top member 32 near the lower edge of the key storing facilities 32*a*, 32*c*. Likewise, an opening 36 is provided for key compartment 32*b*. It will be appreciated that the embodiment of the invention illustrated in FIGS. 3 and 4 offers, if desired, a foldable pocket-insertable key retainer, whereas the preferred embodiment, shown in FIGS. 1 and 2, shows a wallet-or pocket-insertable key retainer.

While the key retainer has been shown in a generally rectangular configuration, it should be understood that various other arrangements and configurations are possible. For example, the key retainer may be of a circular configuration or a square structure. The key receiving slots may be of arc-like configuration and the finger-manipulating apertures may be in the form of circles or squares. It will also be appreciated that the key retainer may include a clip, or the like, for fastening the retainer to a belt, or the like. Additionally, the retainer could include advertising indicia either on the top or bottom numbers. Also, the key retainer could be assembled to accommodate one key or several keys, depending on users' preferences.

It will be obvious to those skilled in the art that various other changes and modifications may be made without departing from the scope of the invention and the invention is not to be considered limited to what is shown in the drawings and described in the specifications.

What is claimed is:

1. A key retainer, particularly having the facility for manually manipulating keys for stored inoperative positions to partially stored operative positions, comprising:

a first planar member having a first edge and a second edge, said second edge opposing and parallel to said first edge;

a second planar member opposing said first planar member and having substantially identical size and configuration to that of said first planar member;

a joining means, at least along said second edge, for joining said first planar member to said second planar member;

a key storing means, defined between said first and second planar members and between said first and second edges, for retaining said keys positioned therein;

a key receiving finger manipulating slot, integral with said first planar member and positioned longitudinally between the length sides of the retainer; and an opening, located in said joining means of one of said first or second edges and defined between said first planar member and said second planar member, for receiving the working ends of said keys therethrough, said opening being just sufficiently wide to allow the working end of the key to be moved from the stored position to the opposite position said opening being in a direct longitudinal path with said key receiving-finger manipulating slot.

2. A key retainer in accordance with claim 1, wherein said first and second planar members consist of semi-flexible material.

3. A key retainer in accordance with claim 1, wherein said key receiving-finger manipulating slot has a width no greater than the widest part of the working end of a conventional key.

4. A key retainer in accordance with claim 1, wherein said key receiving-finger manipulating slot has a length no greater than the length of a conventional key.

5. A key retainer in accordance with claim 1, further including at least three key storing facilities, wherein at least, two of said key storing facilities are spaced apart from one another and said third key storing facility being positioned between said first two key storing facilities.

6. A key retainer in accordance with claim 1, wherein said joining means comprises sewn-in stitching.

7. A key retainer in accordance with claim 6, wherein said three-key storing facilities are of a three-fold arrangement.

8. A key retainer in accordance with claim 2, wherein said semi-flexible material comprises leather.

* * * * *